US006266496B1

(12) United States Patent
Rush et al.

(10) Patent No.: US 6,266,496 B1
(45) Date of Patent: Jul. 24, 2001

(54) CONSTANT DISPLACEMENT OIL WEB SYSTEM AND METHOD OF OPERATING THE SAME

(75) Inventors: Edward Alan Rush; Michael David Maul, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/548,922

(22) Filed: Apr. 13, 2000

(51) Int. Cl.[7] ..... F03F 15/20
(52) U.S. Cl. ..... 399/67; 399/325
(58) Field of Search ..... 399/325, 326, 399/71, 352, 67

(56) References Cited

U.S. PATENT DOCUMENTS

| | | | |
|---|---|---|---|
| 3,186,838 | | 6/1965 | Graff et al. . |
| 3,649,992 | | 3/1972 | Thettu . |
| 3,706,491 | | 12/1972 | Furman et al. . |
| 3,868,744 | | 3/1975 | Thettu . |
| 4,040,383 | | 8/1977 | Vandervort . |
| 4,049,213 | | 9/1977 | Hank et al. . |
| 4,111,378 | | 9/1978 | Barwick . |
| 4,151,403 | | 4/1979 | Woolston . |
| 4,456,193 | | 6/1984 | Westover . |
| 4,485,982 | | 12/1984 | St. John et al. . |
| 4,535,950 | | 8/1985 | Linsyanski . |
| 4,791,447 | | 12/1988 | Jacobs . |
| 4,835,698 | | 5/1989 | Beery et al. . |
| 4,899,197 | | 2/1990 | Davis et al. . |
| 4,913,366 | | 4/1990 | Andou . |
| 5,045,890 | | 9/1991 | DeBolt et al. . |
| 5,049,944 | * | 9/1991 | DeBolt et al. ..... 399/325 |
| 5,170,214 | | 12/1992 | Negoro et al. . |
| 5,202,734 | | 4/1993 | Pawlik et al. . |
| 5,218,410 | | 6/1993 | Nkabayashi et al. . |
| 5,221,948 | | 6/1993 | Dalal . |
| 5,280,274 | | 1/1994 | Uemura et al. . |
| 5,289,246 | | 2/1994 | Menjo . |
| 5,323,217 | | 6/1994 | Christy et al. . |
| 5,327,203 | * | 7/1994 | Rasch et al. . |
| 5,353,107 | | 10/1994 | Sculley et al. . |
| 5,420,678 | | 5/1995 | Rasch et al. . |
| 5,452,065 | | 9/1995 | Bell . |
| 5,482,552 | | 1/1996 | Kikukawa et al. . |
| 5,506,669 | | 4/1996 | Inoue et al. . |
| 5,594,540 | | 1/1997 | Higaya et al. . |
| 5,609,685 | | 3/1997 | Fux . |
| 5,625,859 | | 4/1997 | Moser . |
| 5,678,133 | | 10/1997 | Siegel . |
| 5,749,036 | | 5/1998 | Yoda et al. . |
| 5,797,063 | | 8/1998 | Umezawa et al. . |
| 5,800,908 | | 9/1998 | Hobson et al. . |
| 5,816,165 | | 10/1998 | Huston . |
| 5,825,374 | | 10/1998 | Albertalli et al. . |
| 5,852,462 | | 12/1998 | Lloyd et al. . |
| 5,852,761 | | 12/1998 | Marcelletti et al. . |
| 5,853,832 | | 12/1998 | Ishikawa . |
| 5,887,235 | | 3/1999 | Wayman et al. . |
| 5,890,032 | | 3/1999 | Aslam et al. . |
| 6,070,044 | * | 5/2000 | Hoffman et al. ..... 399/325 |

FOREIGN PATENT DOCUMENTS

| | | | |
|---|---|---|---|
| 10-97153 | * | 4/1998 | (JP) . |

* cited by examiner

*Primary Examiner*—Joan Pendegrass
(74) *Attorney, Agent, or Firm*—Taylor & Aust, P.C.

(57) ABSTRACT

A constant displacement oil web system for an imaging apparatus fuser is disclosed, together with its associated method of operation. In one embodiment, the actual linear advancement of the web during an indexing cycle is detected. In another embodiment, sheet count data, look-up tables and algorithms are used to determine angular rotation necessary to achieve a specified linear advancement of the web. A drive system operating cycle is adjusted to achieve a constant linear advancement of the web.

13 Claims, 4 Drawing Sheets

CONSTANT DISPLACEMENT OIL WEB SYSTEM AND METHOD OF OPERATING THE SAME

This application relates to contemporaneously filed applications Ser. No. 09/548,924, entitled "Multi-Level Oiling Device and Process for a Fuser System", and Ser. No. 09/548,928, entitled "Multi-Level Oiling Device Drive Mechanism", both of which are expressly incorporated herein by reference.

BACKGROUND OF THE INVENTION

1. Field of the Invention

The present invention relates to an electrophotographic imaging apparatus, and more particularly to a fuser oiling apparatus and the associated method involved with its use and operation.

2. Description of the Related Art

In the electrophotographic process commonly used in imaging apparatus such as laser printers, an electrostatic image is created upon a photosensitive member such as a roll or belt. Visible electroscopic marking particles, commonly referred to as toner, are applied to the electrostatic image on the photosensitive material. Thereafter, the toner is transferred to the desired media, which may include paper, transparency sheets or the like.

The toner image applied to the media is not permanent, however, until the toner is fixed by the application of heat. The toner is elevated in temperature sufficiently to cause constituents of the toner to become tacky, and flow into the pores or interstices between fibers of the media. Upon cooling, the toner again solidifies, causing the toner to adhere to the media. Pressure may be applied to enhance the flow of the toner, and thereby improve the subsequent bonding of the toner to the media.

One approach commonly used for thermally fixing the electroscopic toner images is to pass the media, with the toner image thereon, through a nip formed by thereafter elsewhere in the apparatus. The presence of wayward toner particles in the imaging apparatus can degrade the quality of the printed sheets.

To overcome these problems, fusers of the type described above commonly employ an apparatus for applying a release fluid to the surface of the fuser roll. The release fluid creates a weak boundary between the heated roll and the toner, thereby substantially minimizing the offset of toner to the fuser roll, which occurs when the cohesive forces in the toner mass are less than the adhesive forces between the toner and the fuser roll. Silicone oils having inherent temperature resistance and release properties suitable for the application are commonly used as release fluids. Polydimethylsiloxane is a silicone oil that has been used for this purpose advantageously in the past.

Various methods and apparatuses have been used to supply oil to the fuser hot roll, including oil wicking systems, oil delivery rolls and oil webs. Oil wicking systems include reservoir tanks of the desired release agent or oil, and a piece of fabric wick material having one end mounted in the reservoir and the other end spring biased against the hot roll. Oil from the reservoir is drawn through the fabric wick by capillary action, and is deposited against the roll surface. While a wicking system can be effective in supplying oil to the fuser roll, surface deposit of the oil on the roll can be inconsistent, and the replenishment or replacement of the oil and/or system can be difficult and messy.

A variety of oil delivery roll systems have been used in the past, and include a roll nipped against the hot fuser roll. The oil delivery roll may be either freely rotating against the fuser roll or driven against the roll through a gear train. Oil delivered to the surface of the oil delivery roll is deposited on the hot fuser roll as the rolls rotate against each other. Various structures have been used for providing oil to the surface of the oil delivery roll, including reservoirs at the center of the roll providing oil to the surface through small dispersal holes or via capillary action through the outer material. Felts or metering membranes may be used in the oil delivery roll to control the oil flow through the roll. Another style of such roll is referred to as a web wrapped roll, and includes high temperature paper or non-woven material saturated with oil, and wrapped around a metal core.

Oil web systems include a supply spool of web material, generally being a fabric of one or more layers saturated with the desired oil. A take-up spool is provided for receiving the used web. A web path, commonly including one or more guide rolls, extends from the supply spool to the take-up spool. A portion of the web path brings the web material into contact with the hot fuser roll, either by wrapping a portion of the web around the hot roll, or by utilizing a spring-biased idler roll to nip the web material against the fuser roll. As the fuser roll rotates against the web in contact therewith, oil is transferred from the web to the fuser roll. Periodically, a drive mechanism for the take-up spool activates, rotating the take-up spool and advancing web material from the supply spool to the take-up spool, thereby bringing a fresh section of web material into contact with the fuser roll.

Oil web systems can be used to deliver oil with good uniformity across the fuser roll surface. However, the oil flow is dependent upon the amount of web material brought into contact with the fuser roll over a given period of time. Both, the frequency of indexing and the length of web advancement during indexing influence the amount of oil that is applied to the fuser roll over a given time period. In oil web systems utilized heretofore, the simplified drive systems for the take-up spool have been operated for a consistent duration of time, or for established revolutions or partial revolutions of the take-up spool, at constant intervals throughout the life of the web system. Therefore, as spent material passes onto the take-up spool, and the diameter of the take-up spool increases, the linear length of material brought into contact with the fuser roll increases during each web advancement, thereby increasing the amount of oil deposited on the fuser roll.

Excess oil on the fuser roll has undesirable effects. Since the paper passing through the fuser system generally carries away a portion of the oil deposited on the fuser roll, an excess amount of oil on the fuser roll, when picked up by the paper or other media, can cause an undesirable glossy appearance to the media. In duplexing systems, oil carried on the first printed side can be transferred to other areas of the imaging apparatus, when the media passes again through the apparatus for printing on the second side. Excessive amounts of oil deposited in other sections of the imaging apparatus can decrease print quality, and otherwise produce undesirable operating effects. Additionally, increased linear advancement of the web as the take-up spool diameter increases is wasteful, and shortens the useful life of the oiling system, necessitating replacement and expense.

A further problem can occur in the event of a failure of the drive mechanism for the take-up spool, a web break or other failure of the oil web system to operate properly when web advancement is required. Malfunctions such as these may go unnoticed until operating problems result from the lack of oil application to the fuser roll. The same may occur if the oil web is completely advanced off from the supply spool. If unnoticed, these conditions can result in more severe problems after time.

What is needed is a constant displacement oil web system for an imaging apparatus fuser drum in which a more consistent deposit of oil occurs on the fusing drum than occurs from previously known systems. More specifically, what is needed is an oil web system for an imaging apparatus in which a consistent amount of web material is brought into contact with the fuser drum during a given period of operation, throughout the life of the supply spool.

SUMMARY OF THE INVENTION

The present invention provides an imaging apparatus having a constant displacement oil web system for the fuser roll, and an operating method for an oil web system, whereby the deposit of oil from the web on the fuser roll is consistent throughout the life of the web supply spool.

The present invention comprises a supply spool having a web wound thereon, the web having oil therein. A take-up spool is provided for receiving the spent web from which the oil has been transferred to the fuser roll. A drive mechanism is activated periodically, for rotating the take-up spool and advancing the web. A web path extends from the supply spool to the take-up spool, and includes one or more guide rolls defining the path such that, along at least a portion of the path, the web material is brought into contact with the fuser roll. A drive mechanism control receives input such that the operation of the drive mechanism indexes consistent lengths of web material along the path throughout the life of the supply spool.

In one form of the invention, consistent linear advancement of the web material is accomplished through the use of an encoder wheel attached to a shaft located for constant contact with the web material. A sensor is placed to determine rotation of the encoder wheel, and thereby the actual linear advancement of the web material. Operation of the oil web system drive mechanism is adjusted in response to the detected advancement of the web.

In a second form of the invention, sheet counter data and a stored look-up table and algorithm are used to calculate take-up roll diameter, and the angular displacement on the take-up spool necessary to achieve consistent linear advancement of the web material An advantage of the present invention is the consistent application of oil to the fuser roll through the consistent linear advancement of the web material.

Another advantage of the present invention is increased life for a web supply spool resulting from consistent use of the material and the minimization of waste.

Yet another advantage of the present invention is the minimization of oil dumps and, therefore, the reduction of oil carry over by printed media and resulting contamination of other portions in the imaging apparatus or production of undesirable glossy images.

A further advantage of the present invention is the detection of a spent or malfunctioning oil web system, prompting replacement or repair of the system.

BRIEF DESCRIPTON OF THE DRAWINGS

The above-mentioned and other features and advantages of this invention, and the manner of attaining them, will become more apparent, and the invention will be better understood by reference to the following description of the embodiments of the invention, taken in conjunction with the accompanying drawings, wherein.

Figure 2:
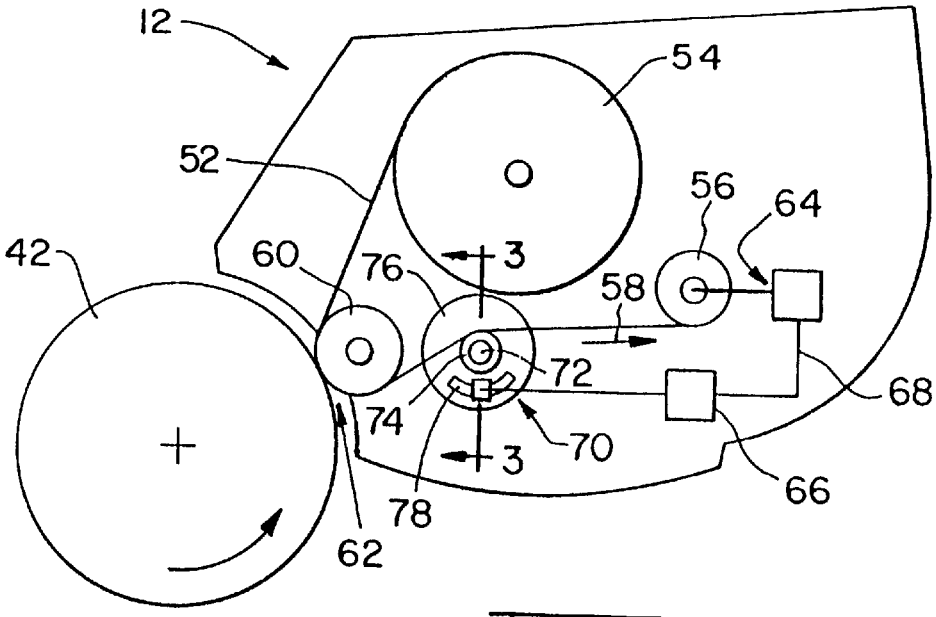
FIG. 2 is a schematic representation of an oil web system according to a preferred form of the present invention.
Figure 3:
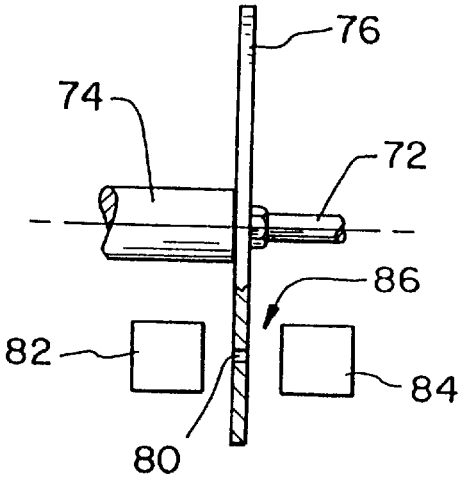
FIG. 3 is a cross-sectional view of the oil web system shown in FIG. 2, taken along line 3—3 of FIG. 2.
Figure 4:
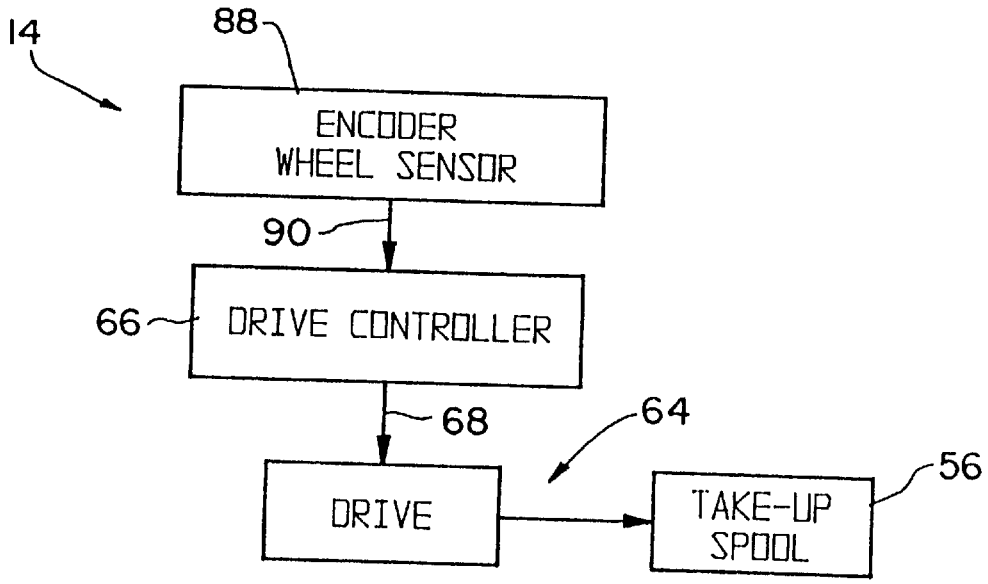
Figure 6:
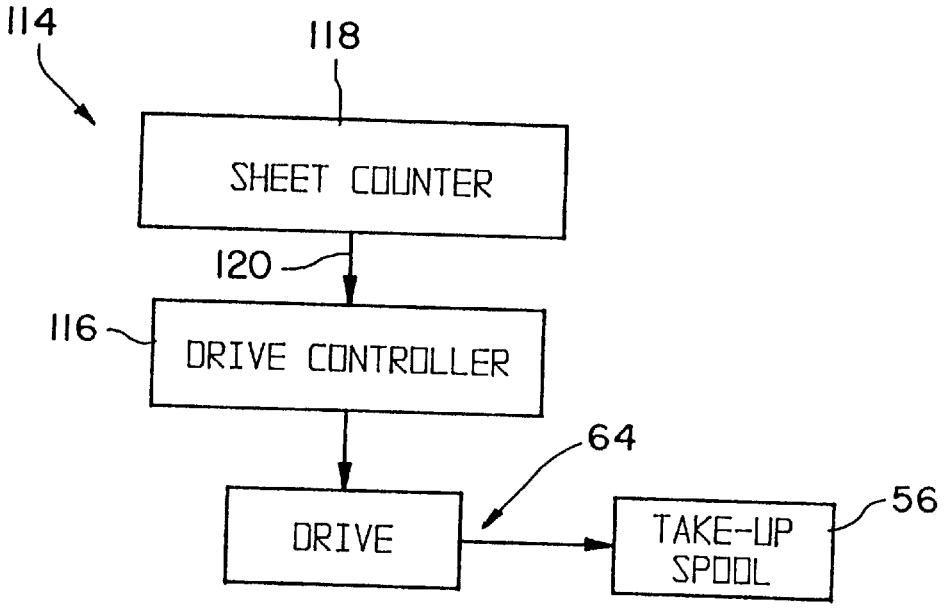
Figure 5:
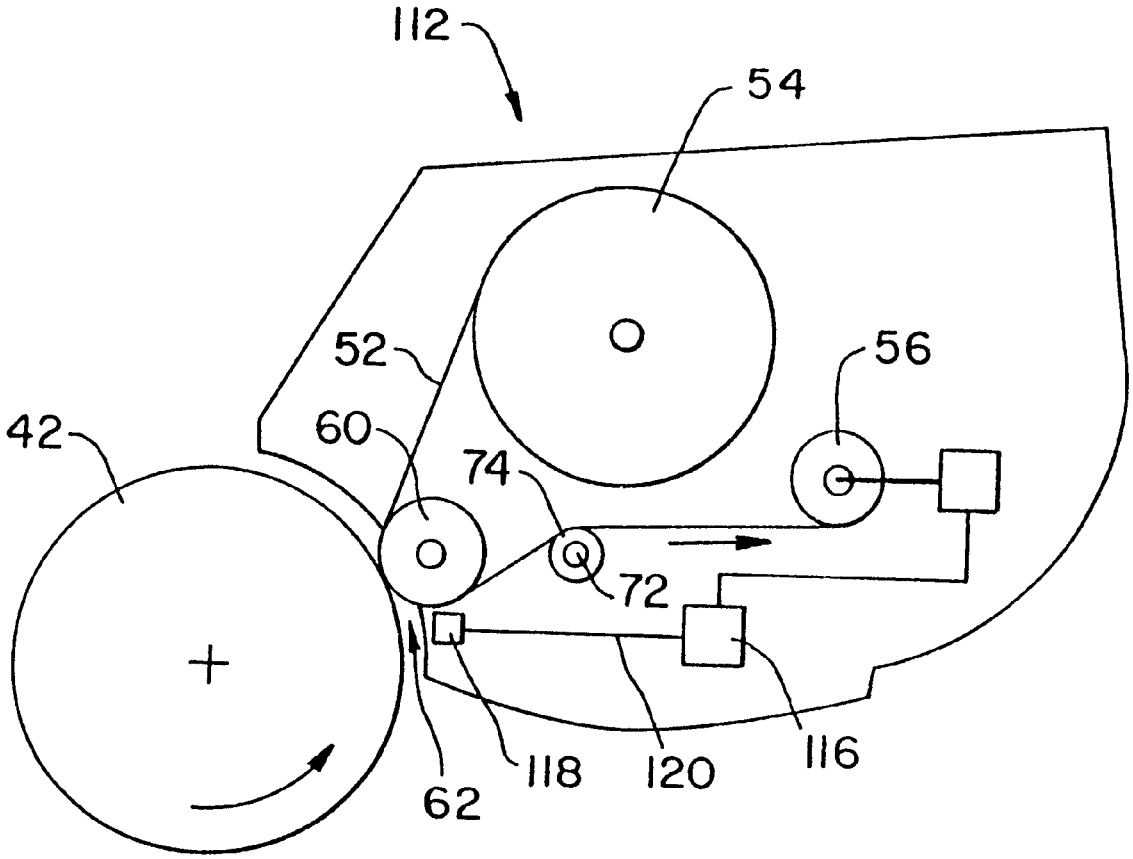

FIG. 4; is a flow diagram of the control procedure, according to the present invention, for the oil web system shown in FIG. 2 and FIG. 3;

FIG. 5 is a schematic representation similar to that of FIG. 2, but showing a modified embodiment of the present invention; and FIG. 6 is a flow diagram of an alternative control procedure, according to the present invention, for the oil web system shown in FIG. 5.

Corresponding reference characters indicate corresponding parts throughout the several views. The exemplifications set out herein illustrate one preferred embodiment of the invention, and such exemplifications are not to be construed as limiting the scope of the invention in any manner.

DETAILED DESCRIPTION OF THE INVENTION

Figure 1:
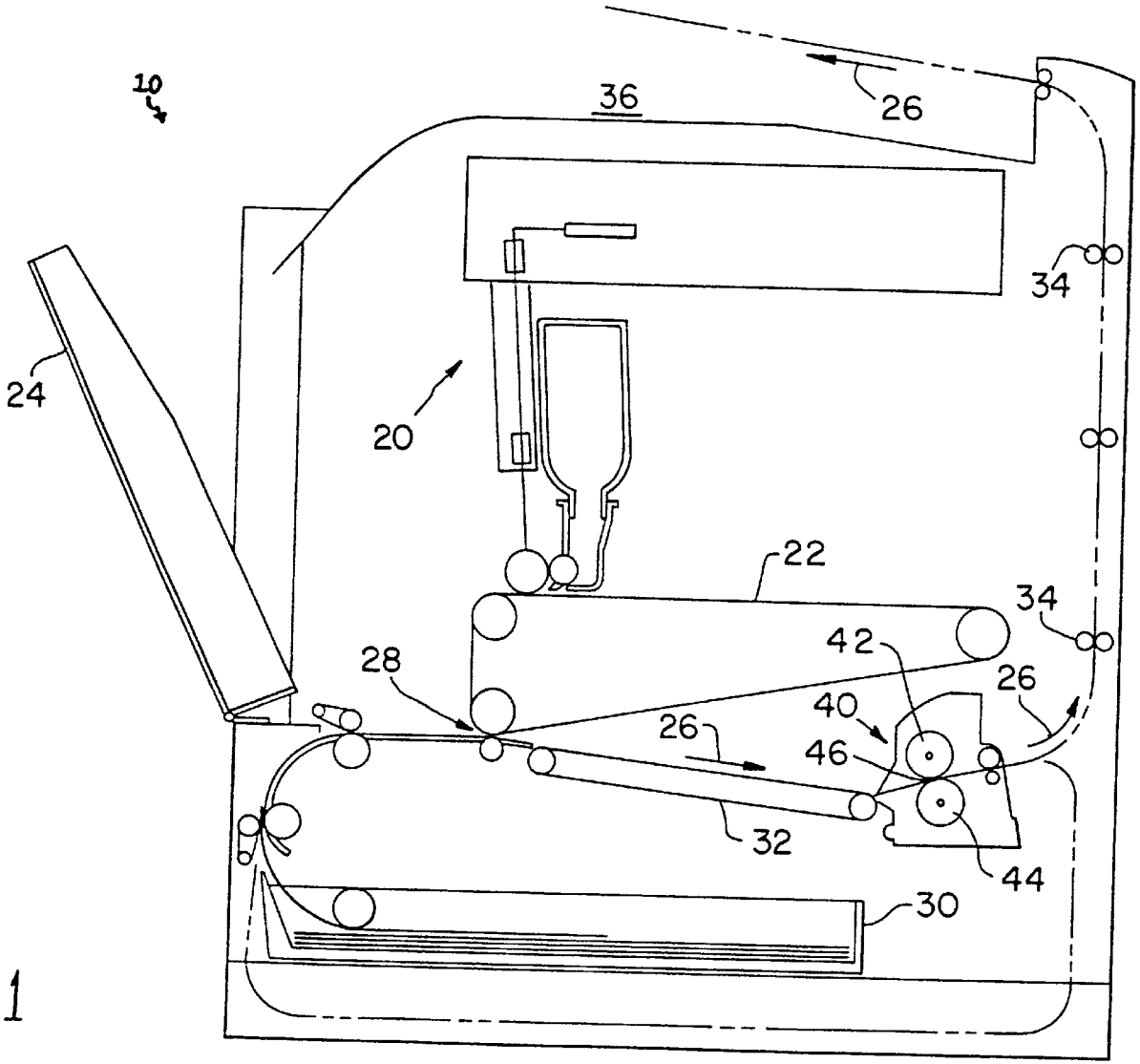
FIG. 1 is a simplified schematic representation of a laser printer in which the present invention may be utilized advantageously.

Referring now more specifically to the drawings, and to FIG. 1 in particular, numeral 10 designates an imaging apparatus in the form of a laser printer, in which a constant displacement oil web system 12 of the present invention, shown in FIG. 2, may be used advantageously when operated in accordance with an encoder wheel drive mechanism control method 14 shown in FIG. 4.

It should be understood that the laser printer 10 shown in FIG. 1 is merely one type of imaging apparatus in which the present invention may be used advantageously. Other types of imaging apparatuses, including other types and configurations of laser or other printers, may readily employ use of the present invention to achieve the advantages incumbent therein. The particular embodiment of the laser printer shown in FIG. 1 should not be construed as a limitation on the use and application of the present invention, nor on the scope of the claims to follow.

The general structure of a laser printer, and the operation of the electrophotostatic process used therein, will be readily understood by individuals skilled in the art, and will not be described in detail herein. For reference purposes in describing the present invention, in FIG. 1 a laser printhead 20 is shown, which creates an electrostatic image in known fashion on a photosensitive member. Toner is applied to the electrostatic image. It should be understood that in a non-color printer only one printhead may be used; however, in a color printer separate printheads for black, magenta, cyan and yellow toners may be used. The toner image is created on a photoconductive drum and/or image transfer belt 22, and thereafter transferred to the selected media. The media, such as paper or the like, on which the image is to be printed, is provided from a media supply tray 24 or 30. The media follows a media path, indicated by the arrows 26, from tray 24 or 30 through an image transfer nip 28, at which the image is transferred from image transfer belt 22 to the media. Media path 26 includes a series of guide surfaces or belts 32, and guide rolls 34 to direct the media through printer 10. A printed media receiving zone 36 is provided at the end of media path 26, to accumulated the completed pieces of media.

To fix the toner image on the media, a fuser 40 is provided, to apply heat and pressure to the image on the media, thereby causing the toner to melt and flow into the pores or interstices of the media. Fuser 40 includes a hot roll 42 and a backing roll 44 creating a fuser nip 46 through which the media passes. To prevent paper from sticking to hot roll 42, and to minimize toner offset to hot roll 42, oil web system 12 is provided, to apply a release agent, such as silicone oil, to the surface of hot roll 42.

Referring now to FIG. 2, oil web system 12 includes an elongated web 52, which has been saturated or coated with the selected release agent to be applied to fuser hot roll 42. The web material, preferably, is a non-woven fabric of polyester and aramid fibers, such as Nomex200 manufactured by and available from DuPont. The release agent may be a silicone oil such as polydimethylsiloxane, which has been used advantageously in the past. Web 52 is provided on a supply spool 54, from which it is dispensed periodically to apply release agent on hot roll 42. The used or spent portion of web 52, from which the release agent has been transferred to fuser hot roll 42, is accumulated on a take-up spool 56. Between supply spool 54 and take-up spool 56, web 52 follows a web path, indicated by arrows 58, the web path being defined by positions of web guiding members, which includes the relative positions of supply spool 54, take-up spool 56 and other guide rolls and/or guide surfaces, as necessary. Along a portion of the web path, web 52 comes in contact with hot roll 42. In the structure shown in FIG. 2, a spring loaded biasing roll 60 is shown, to urge web 52 against hot roll 42 at an oiling nip 62. As hot roll 42 rotates against web 52 in oiling nip 62, the release agent from web 52 is transferred to the surface of hot roll 42.

As shown in FIG. 2, hot roll 42 and take-up spool 56 rotate in the same direction, counterclockwise as shown, so that at oiling nip 62 hot roll 42 and web 52 move in opposite directions past each other. In this manner, as web 52 drags against hot roll 42, hot roll 42 creates tension on that portion of web 52 between biasing roll 60 to take-up spool 56, and tension in the wind-up of used portions of web 52 on take-up spool. Tension in the wind-up creates a smoother, cleaner wind-up on take-up spool 56. Additionally, the directional relationship between web 52 and hot roll 42 causes a slackening of that portion of web 52 between supply spool 54 and biasing roll 60, thereby inhibiting free-wheeling or accidental unwind of supply spool 54.

While biasing roll 60 has been shown and described for bringing web 52 into contact with hot roll 42, it should be understood that other arrangements for a web path can be used as well. For example, two spaced idler rolls may be used, positioned closely to hot roll 42, such that web 52 partially wraps hot roll 42 along the portion of the web path between the idler rolls. Alternatively, a single idler roll could be used, with the idler roll and take-up spool 54 positioned in a manner to provide the same relationship, that is a segment of web 52 wrapping a portion of hot roll 42 between the idler roll and take-up spool 54. Web guiding surfaces other than idler rolls also may be used to define a web path.

To effect transfer of web 52 from supply spool 54 to take-up spool 56, a drive mechanism 64 is provided, connected to take-up spool 56 for rotation thereof to draw web from supply spool 54. Drive mechanism 64 may include an independent, dedicated prime mover and gear train, a gear train from a common drive for other apparatus in printer 10, a direct drive prime mover, or the like. The prime mover may be a stepper motor, a solenoid, or other positional activator. Such drive mechanisms are known in the industry, and will not be described in further detail herein. Operation of drive mechanism 64 is controlled by drive controller 66, which transmits signals to drive mechanism 64, including start and stop signals. Drive controller 66 may include a microprocessor, and other digital or analog control components, and a suitable signal transmission pathway 68 to drive mechanism 64.

In accordance with the present invention, a web advancement sensor system 70 is provided. The sensor system 70 includes an idler shaft 72, properly journaled in bearings, low friction bushings or the like (not shown). A web engagement portion 74 of shaft 72, such as a sleeve, boss, shoulder portion of shaft 72, or the like, is positioned to be in contact with, and partially wrapped by web 52. Advantageously, web advancement sensor system 70 will be disposed along that segment of web 52 between take-up spool 56 and biasing roll 60, that segment along which there is tension in web 52. Since web 52 partially wraps engagement portion 74, as web 52 advances along the path, idler shaft 72 of web advancement sensor system 70 is rotated in direct proportion to the linear movement of web 52.

An encoder wheel 76 is disposed on idler shaft 72 or engagement portion 74, for rotation therewith. Encoder wheel 76 includes surface indicia, holes or the like, movement of which may be detected by an appropriate sensor. In the embodiment shown, a band or region 78 is provided near the periphery of the encoder wheel 76. Within band or region 78, a hole or opening 80 (FIG. 3), or a plurality thereof are provided, and may be in specific patterns or orientations. Although band or region 78 is shown as only a segment on wheel 76, it may extend along a greater portion or entirely around encoder wheel 76, near the periphery thereof. A transmissive sensor, including an emitter 82 and a receiver 84, is used to detect movement of encoder wheel 76, as evidenced by the passage of hole or holes 80 through a region 86 between emitter 82 and receiver 84. The structures and operations of appropriate sensors that may be used in the present invention, to ascertain the pattern or frequency of hole passings, are known for other uses, will not be described in further detail herein and will be referred to as an encoder wheel sensor 88. Data signals from encoder wheel sensor 88 are transmitted along a suitable signal pathway 90 to drive controller 66.

Other types of web movement sensors may be used advantageously in the present invention. The encoder wheel 76 and encoder wheel sensor 88 shown and described are not the only suitable sensors, but are a preferred, low cost and accurate alternative.

In the conventional operation of an oil web system, the drive mechanism is operated at pre-established intervals for a pre-established duration of time. Therefore, when the oil web system is new, with most of the length of the web being on the supply spool and only a small portion thereof on the take-up spool, a certain length of web material will pass through the oiling nip during each activation of the drive mechanism. However, as the diameter of the supply spool decreases, and the diameter of the take-up spool increases, during the same duration of web advancement, a longer segment of web will pass through the oiling nip. Therefore, more release agent or oil will be applied to the hot roll when the take-up spool is large in diameter than when the take-up spool is of a smaller diameter. This is wasteful of the web system and oil, and can provide an excessive amount of oil on the hot roll, that is more oil than is required for release of the media.

In the use and operation of oil web system 12 according to encoder wheel drive mechanism control method 14, the frequency of advancement or indexing of web 52 is also determined by pre-established parameters in drive controller 66. When the pre-established time interval has passed, drive controller 66 activates drive mechanism 64, to rotate take-up spool 56. Web 52 is drawn from supply spool 54, through oiling nip 62, and spent portions of web 52 are wrapped onto take-up spool 56. As web 52 is advanced along that segment of the web path between biasing roll 60 and take-up spool 56, web 52 passes over and rotates idler shaft 72, and thereby encoder wheel 76. As encoder wheel 76 rotates, and holes 80 pass through region 86 between emitter 82 and receiver 84, data related to the passing of holes 80 is transmitted along signal pathway 90 to drive controller 66, in known manner. Using data from encoder wheel sensor 88, drive controller 66 terminates the drive signal to drive mechanism 64, stopping advancement of web 52 when the desired length of web 52 has moved along the web path. This determination is made independent of the angular movement of take-up spool 56. In this manner, regardless of the diameter of take-up spool 56, a consistent, specified, predetermined length of web 52 is advanced during each indexing step. The linear advancement of web 52 will remain constant, for any diameter of take-up spool 56 throughout, the duration of the life of oil web system 12.

In addition to the consistent application of oil through out the life of oil web system 12, oil web system 12 can provide a fail-safe response to system malfunctions. If drive mechanism 64 fails, web 52 breaks or web 52 reaches its end, no movement of encoder wheel 76 will occur if web 52 is not advanced. If, in spite of activation signals having been sent to drive mechanism 64, drive controller 66 determines that no advancement of web 52 has occurred, an error signal can be sent, the machine shut down or other steps taken to prevent more serious ramifications from the failure of the oil web system 12.

An alternative embodiment of the present invention is shown in FIG. 5 and FIG. 6. Oil web system 112, shown in FIG. 5, is similar to the oil web system 12 shown in FIG. 2, but without the use of encoder wheel 76, emitter 82 and receiver 84. However, web oil system 112 may also be operated to provide consistent incremental advancement of web 52, independent of the diameter of take-up spool 56. FIG. 6 shows a sheet count operating method 114 for the oil web system 112 shown in FIG. 5. Drive controller 116, which may be a microprocessor, uses a stored look-up table, or other algorithm, to relate the angular displacement necessary for a given diameter of take-up spool 56 to achieve the desired linear displacement of web 52. A sheet counter 118 provides sheet count data to drive controller 116 along a signal pathway 120. Drive controller 116 relates the sheet count data to the calculated take-up spool diameter, and to the required angular rotation of the take-up spool necessary to provide the specified linear advancement of the web. Sheet count data may be provided from common sheet count sensors provided for other purposes elsewhere in the imaging apparatus. However, to eliminate the need for resetting the sheet count information when an oil web system 112 is replaced, advantageously sheet counter 118 is a part of any unitary structure of oil web system 112. In this way, the sheet count data will be unique to the specific oil web system 112, independent from the sheet count for fuser 40 or the total sheet count history of printer 10. Suitable sheet count devices are known to those knowledgeable in the art, and will not be described in further detail herein. Utilizing the sheet count data, drive controller 116 generates start and stop data signals, which are transmitted to drive mechanism 64 along signal transmission pathway 68.

While this invention has been described as having a preferred design, and a modification thereof, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A constant displacement oil web system in an imaging apparatus fuser having a fuser roll, comprising:

an elongated web carrying fuser roll release agent;

a supply spool for holding an unused portion of said web;

a take-up spool for holding a used portion of said web;

web guiding members defining a web path from said supply spool to said take-up spool, said web path including a portion thereof for positioning said web against the fuser roll of the imaging apparatus, for transferring release agent from said web to the fuser roll;

a drive mechanism operatively connected to said take-up spool for rotating said take-up spool;

a drive mechanism controller activating and deactivating said drive mechanism and adapted for varying operation of said drive mechanism to achieve consistent linear advancement of said web during each activation cycle of said drive mechanism; and a web advancement sensor system operatively disposed to detect actual linear advancement of said web, and a drive mechanism microprocessor receiving data from said web advancement sensor system.

2. The constant displacement oil web system of claim 1, wherein said web advancement sensor system includes an encoder wheel.

3. The constant displacement oil web system of claim 2, wherein said encoder wheel is disposed on a shaft in contact with said web, movement of said web drives rotation of said shaft, and said encoder wheel rotates in direct proportion to the linear movement of said web.

4. The constant displacement oil web system of claim 2, wherein said web advancement sensor system includes a transmissive sensor operatively disposed to detect movement of said encoder wheel, and said transmissive sensor includes an emitter and a receiver disposed on opposite sides of said encoder wheel.

5. The constant displacement oil web system of claim 4, wherein said encoder wheel defines at least one opening disposed near the periphery of said encoder wheel, and said transmissive sensor is operatively disposed to detect movement of said opening.

6. An imaging apparatus comprising:

a fuser having a hot roll, a backing roll and a fuser nip formed between said hot roll and said backing roll;

an oil web system including a material web, a supply spool for said material web and a take-up spool;

web guiding members defining a web path between said supply spool and said take-up spool, said web guiding members urging a portion of said web into contact with said hot roll;

a drive mechanism operably connected to said take-up spool to advance said web from said supply spool to said take-up spool along said web path;

a drive mechanism controller for adjusting an operating cycle of said drive mechanism to provide substantially consistent linear advancement of said web along said path during each operating cycle of said drive mechanism; and a web advancement sensor system and a drive control microprocessor adapted to receive data from said web advancement sensor system.

7. The imaging apparatus of claim 6 in which said web advancement sensor system includes an encoder wheel adapted and disposed to be operated by advancement of said web.

8. The imaging apparatus of claim 6, in which said web advancement sensor system includes an idler shaft disposed in contact with said web along said web path, said idler shaft being adapted and disposed for rotation by advancement of said web, and an encoder wheel connected to and rotated by said idler shaft.

9. The imaging apparatus of claim 8, further comprising an encoder wheel sensor having an emitter and a receiver disposed on opposite sides of said encoder wheel.

10. A method for operating a constant displacement oil web system for a fuser roll in an imaging apparatus, comprising the steps of:

providing a web carrying a release agent therewith, a supply spool for an unused portion of the web, and a take-up spool for a used portion of the web;

extending the oil web from the supply spool to the take-up spool along a web path;

biasing a portion of the web along the web path against the fuser roll;

rotating the take-up spool to draw web material along the web path from the supply spool to the take-up spool;

operating a drive mechanism to perform said rotating step;

controlling said operating step in a manner whereby substantially consistent linear advancement is achieved for any portion of the web material;

detecting the movement of the web;

determining the actual linear advancement of the web; and calculating a duration for said rotating step dependent on the actual detected advancement of the web.

11. The method of claim 10, wherein said detecting step includes the steps of operating an encoder wheel in direct proportion to the linear advancement of the web, and sensing operation of the encoder wheel.

12. The method of claim 10, further comprising the steps of rotating an encoder wheel in direct proportion to the advancement of the web, and sensing the movement of the encoder wheel with an encoder wheel sensor.

13. The method of claim 12, further comprising the step driving a shaft attached to the encoder wheel by drawing the web across a surface of the shaft.

* * * * *